United States Patent [19]

Dickey

[11] Patent Number: 4,864,157

[45] Date of Patent: Sep. 5, 1989

[54] REDUCED ARCING CONTACT SWITCHING CIRCUIT

[75] Inventor: John A. Dickey, Palm Bay, Fla.

[73] Assignee: Spatron Corporation, Palm Bay, Fla.

[21] Appl. No.: 193,041

[22] Filed: May 12, 1988

[51] Int. Cl.[4] ..... H01H 9/56

[52] U.S. Cl. ..... 307/135; 307/137; 361/3; 361/5; 361/6

[58] Field of Search ..... 307/125–135, 307/137; 361/2–19, 89, 90, 91, 92, 93, 101, 110, 111, 112, 113, 43

[56] References Cited

U.S. PATENT DOCUMENTS

| | | | |
|---|---|---|---|
| 3,555,354 | 1/1971 | Kotos | 361/5 |
| 3,566,152 | 7/1969 | Casey | 361/6 |
| 4,001,643 | 1/1977 | Ramberg et al. | 361/6 X |
| 4,103,316 | 7/1978 | Kaneko | 361/3 |
| 4,245,184 | 1/1981 | Billings et al. | 361/3 X |
| 4,356,525 | 10/1982 | Kornrumpf et al. | 361/3 X |
| 4,360,847 | 11/1982 | Bloomer et al. | 361/3 |
| 4,618,906 | 10/1986 | Paice et al. | 361/5 |
| 4,704,652 | 11/1987 | Billings | 361/5 |
| 4,709,296 | 11/1987 | Hung et al. | 361/5 X |

*Primary Examiner*—William M. Shoop, Jr.
*Assistant Examiner*—Paul Ip

[57] ABSTRACT

A reduced arcing contact switching circuit. It is desirable to control the switching of electrical contacts so that opening and closing occur at the time when zero power is being transferred to the load so as to substantially reduce arcing at the contacts and thus extend contact life. In a purely resistive circuit, for example, the supply voltage and current will be in-phase and contact switching should occur when the current and voltage signals pass through zero degree phase angle. Control of contact switching is accomplished with this invention by producing a count value that represents the phase angle at which contact movement should be initiated, so that the actual closing or opening will occur at the desired phase angle. When the count value and a preselected count are approximately equal, a flip-flop is enabled to pass the control information (open or close contacts) to a relay driver. The relay driver energizes or deenergizes (as the case may be) the relay to open or close the contacts.

21 Claims, 5 Drawing Sheets

REDUCED ARCING CONTACT SWITCHING CIRCUIT

FIELD OF THE INVENTION

The present invention relates in general to relay switching controls and is particularly directed to the reduction of arcing in low cost high power relay controlled equipment.

BACKGROUND OF THE INVENTION

The majority of low cost relay controlled power equipment, ie. consumer products incorporating power controls, are designed with relays that are rated for the statistical and worst case arcing loads that can be anticipated when switching typical AC loads such as heating elements and motors. The basis for this is that the arcing during switching is the primary destructive force that limits the life of the relay contacts. Although there are other aging mechanisms involved in relays, this invention is primarily concerned with reduction in aging effects due to relay arcing.

In these cases where the contact arcing is the primary aging mechanism, the life of the relay is inversely proportional to the amount of arcing incurred during operation. The typical approach to solving this problem has been that if the relay can't handle the arcing and meet the reliability requirements for the product, get a bigger relay.

This approach has been used on most if not all consumer products and most industrial products, however, at the industrial and/or military level, where cost is not necessarily a limiting factor, other approaches have been used such as special magnetic blow-out coils to quench arcing.

SUMMARY OF THE INVENTION

In accordance with the present invention, there is provided a new and improved apparatus for the reduction of arcing in low cost relay controls with an associated increase in the lifetime and realiability of the relays. This reduction in contact arcing is based on the principle of controlling the closure time of the relay contacts to coincide with a particular range of the phase angle of the power line AC waveform.

It is common knowledge that the voltage and current applied to a load from an alternating current power source crosses zero twice each cycle, although they only cross zero at exactly the same time if the load is purely resistive. It is evident, then, that if the contacts of a switching device were to apply or remove the power to the load at one of those times, the contacts would really be breaking no load since the alternating current has already reduced the power to the load to zero as it followed through it's swing from positive current flow to negative current flow or from negative current flow back to positive.

Considering the resistive load case first, it is only necessary that the relay contacts open or close at a zero crossing to avoid switching actual power to the load. If there is no power to the load there will certainly be no arcing of the contacts and the lifetime of the relay contacts will be extended greatly.

Digressing to practical considerations, relay contacts bounce on closing, and may have some sticking or sliding during opening depending on relay design, so at both cases the opening or closing of the relay does not happen at a point in time but during a time interval. For small to medium size relays, this time interval ranges from 1 to 4 or 5 milliseconds. This time is not how long it takes the relay to operate, but the time in which the contacts are touching and still moving. Other practical problems are the fact that being a mechanical device the time to operate will vary some from one relay to the next and from one operation to the next. Non-resistive loads also pose a problem since the current and voltage are not in phase with each other thereby making them cross through zero phase angle at different times.

All these practical problems taken into account, it is still reasonable and practical to be able to force the relay contacts to open or close within about 20 to 40 degrees of the zero crossing point on medium size relays and even closer on smaller relays. This reduces the voltage and current that the relay must switch by a factor of 2 to 4 and the power that the relay must switch by a factor of 4 to 16 worst case, and by a factor of 2 to 8 on the average. This average value is based on comparison to a non-controlled random phase angle opening and closing of the contacts. Since relay lifetime is inversely proportional to the amount of power that the contacts must switch (for loads that are a significant percentage of the contact ratings), then it can be concluded that by controlling the closure phase angle of the contacts, the relay life could be extended by as much as a factor of 8.

The current invention accomplishes the controlling of the switching phase angle of the relay contacts as follows.

The signal from a relatively stable oscillator operating at a relatively high frequency compared to the alternating current power frequency is fed into a counter that is synchronized to the zero crossing of the power source. The count represents the fractional portion of the cycle since the last zero crossing. A preset reference value of phase angle is selected by empirical means and stored in the system. This value represents the phase angle of the power source during which the relay coil must be energized such that the relay contacts will come together at a later time coinciding with a zero-crossing of the power source. This stored preset phase angle is compared to the output of the counter as it counts and when they are equal, a signal is gated out to the relay driver to turn it on or off. A more elaborate system of different times for on and off can also be implemented if the relay does not exhibit relatively symmetrical on and off transitions. Also, different 'timeslots' (i.e., preset values) can be designated for different relay types in the same system.

Another addition that can be made to the system is to provide a feedback loop to the reference time to cause it to track the actual closure time over the life of the relay. This is accomplished by comparing the actual phase angle when the power is applied to the load with the desired phase angle when power should have been applied. The result of this comparision is a feedback signal that adjusts the reference time to ensure that the relay opens and closes at the correct phase angle as the relay characteristics change with age.

This system can be adapted for use with inductive or capacitive loads by selecting the preset reference phase angle somewhere between the zero crossings of the voltage and current where the total arcing is minimized during contact switching. If the relay contacts did not bounce then the ideal place to switch the load is at the zero crossing of the current for all load types.

It is also important to note that this approach can be implemented with relays employing AC or DC coils since the magnetic flux build-up in an AC coil will follow some consistent pattern if started at the same phase angle of the power source each time just as the DC coil follows a consistent but different flux build-up pattern.

BRIEF DESCRIPTION OF THE DRAWING

The present invention can be more easily understood, and the further advantages and uses thereof more readily apparent, when considered in view of the description of the preferred embodiments and the following figures in which.

DESCRIPTION OF THE PREFERRED EMBODIMENT

Before describing, in detail, the particular improvements afforded by the present invention, it should be noted that the present invention primarily is in a novel structural combination of conventional signal processing circuits and is not in the particular detailed configurations thereof. Accordingly, the structure, control and arrangement of such conventional circuits have been described and illustrated in the figures by readily understandable block descriptions and diagrams, which show only those specific details that are pertinent to the present invention, so as not to obscure the disclosure with structural details which will be readily apparent to those skilled in the art having the benefit of the description herein.

In addition, throughout the present description, it is to be understood that the functions of the conventional circuit blocks used in this invention and how those functions are interconnected form the basis for this invention, irregardless of the practical or physical form in which those conventional circuits are chosen to be implemented.

Figure 1:
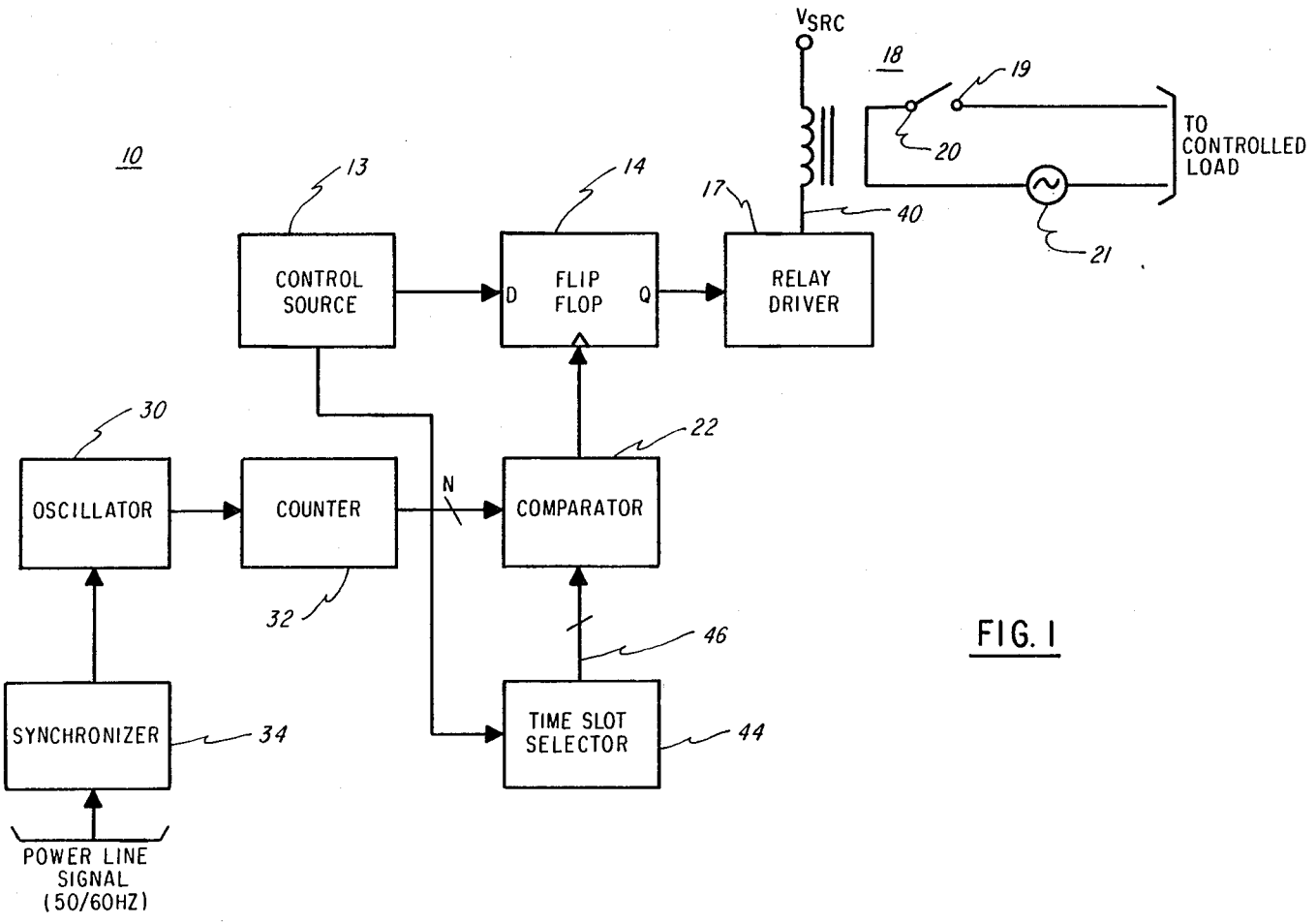
FIGS. 1 and 2 are block diagrams of a reduced arcing contact-switching circuit constructed according to the teaching of the present invention.

FIG. 1 shows a schematic block diagram of a controlled contact closure system 10 constructed in accordance with the present invention. Control information from a control source 13 is allowed to pass to the relay driver 17 by way of flip flop 14 only at specific times as controlled by the clock or enable signal from the comparator 22. The flip flop 14 should be an edge sensitive device that passes a sampling of the control information to the Q output terminal thereof only at the transition edge of the enable signal. Depending on the specific design, the flip flop 14 can be triggered at the leading or lagging edge of the enable signal.

As determined by the control information provided via the flip flop 14, the relay driver 17 energizes or deenergizes the relay 18 from a voltage source Vsrc. This action opens or closes the contacts 19 and 20, and applies power from an ac source 21 to a load (not shown in FIG. 1.)

An oscillating signal, which must be approximately some multiple of the ac power line frequency signal, from the oscillator 30 is input to a counter 32. The counter 32 produces a count signal that represents the phase angle of the AC power line frequency. The oscillator 30 is synchronized to the power line frequency by a synchronization signal from a synchronizer 34, which is responsive to the ac power line signal having the same phase as that from the ac source 21. The counter 32 is a fixed modulus counter. Alternatively the oscillator 30 can free run and the synchronization signal can synchronize the counter 32 by use of a dual modulus counter. The dual modulus counter synchronizes the counting to a number that is less than the desired average count if the count is behind what it should be and counts to a number that is higher than the desired average if the count is ahead of what it should be. After a few cycles the count will be resynchronized to the power line signal. Other approaches may also exist to synchronize the count to the power line frequency, but the only requirement for the present invention is that the output of the counter 32 must always be the same count plus or minus approximately one count every time the power line phase angle passes through the same point. This provides the consistent correspondence that is needed so that the count signal has a linear mapping relationship with the phase angle of the power line frequency as a function of time. While the same count plus or minus one count is the desired relationship in the preferred embodiment, it will be recognized by those skilled in the art that other relationships can be utilized, dependent on the desired accuracy of the controlled contact closure system 10. If the counter 32 has a fixed modulus, the counter 32 resets automatically at each zero crossing of the power line signal.

The frequency of the oscillator 30 and the modulus of the counter 32 are selected by first deciding the required resolution or accuracy with which the timing of the relay 18 transitions are to be controlled. A higher frequency oscillator 30 along with a higher modulus counter 32 provides for more accurate control of the operational timing of the relay 18. Typical selection of the oscillator frequency will pick it high enough so that individual counts of the counter 32 will be a slightly smaller time step than the typical consistency of the time required for the contacts of the relay 18 to open or close. Selecting an oscillator frequency higher than this does not significantly improve system performance since the mean variance of the relay closure time becomes the dominant factor. A good indicator for the required oscillator frequency is one over the standard deviation of the relay opening and closing times. For many small typical control relays a good value for the oscillator frequency may be 12 times the line frequency, thereby providing control of the relay 18 to within plus or minus 15 degrees of any desired power line phase angle. This places the actual controllability of the contact closure/opening to within 15 degrees of the zero crossing plus the operation-to-operation variance of the relay itself.

Once the oscillator 30, the counter 32, and the synchronizer 34 have been chosen, the remaining factor is to select the actual count at which time the control information is to be passed through the flip flop 14 to the relay driver 17. In the preferred embodiment the control information is an open or close command. The selection of the actual count must typically be accomplished by empirical means. One or preferably more relay samples are tested and an average value is determined for the time required for the relay to open or close. These can be a first timeslot value for opening the relay and a second timeslot slot value closing if the relay 18 has a significant difference between its opening and closing characteristics. The timeslot values are selected in the timeslot selector 44, as determined by a control signal from the control source 13, to the timeslot selector 44. The timeslot values are input to the comparator 22 via the conductors 46. The actual timeslot number then is determined by starting at the count signal that corresponds to the zero phase angle of the power line frequency signal and reversing the counting process of counter 32 by the number of counts that will equal the average amount of time required for the relay to operate. In operation, the counter 32 outputs counts, which represent the phase angle of the ac power line signal, to the comparator 22. When the actual count is equal to the timeslot value from the timeslot selector 34 the flip flop 14 is enabled so that the control information will be passed on to the relay driver 17 at that time and the average amount of time required for the relay to operate will then pass before the power line voltage reaches its zero phase angle point and the contacts 19 and 20 open or close. For the case of inductive or capacitive loads where the voltage and current do not cross zero at the same time, it will be desirable for the relay contacts to close at some point between the voltage and current zero crossings. This is accomplished by simply selecting the desired relay contact operation phase angle of the power line and counting backwards from there instead of from zero phase angle to select the desired timeslot value.

Figure 2:
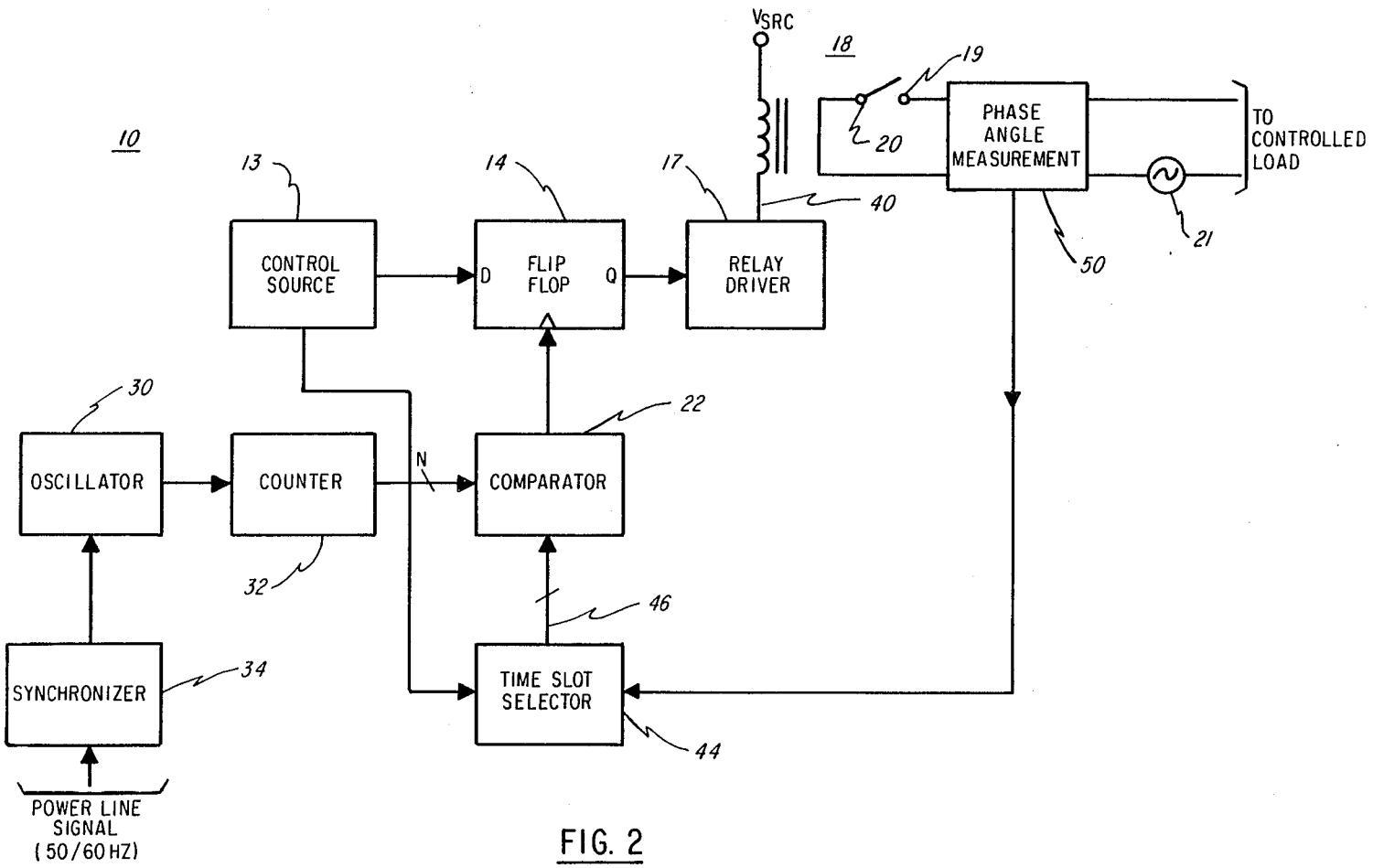

FIG. 2 is identical to FIG. 1 with the addition of a phase angle measurement element 50 that measures the actual phase angle at which the relay contacts 19 and 20 open or close. A signal from the phase angle measurement element 50 is input to the timeslot selector 44 for changing the timeslot values so that the relay 18 opens or closes at the desired time. This embodiment is especially useful to compensate for the aging effects on the relay 18.

Figure 3:
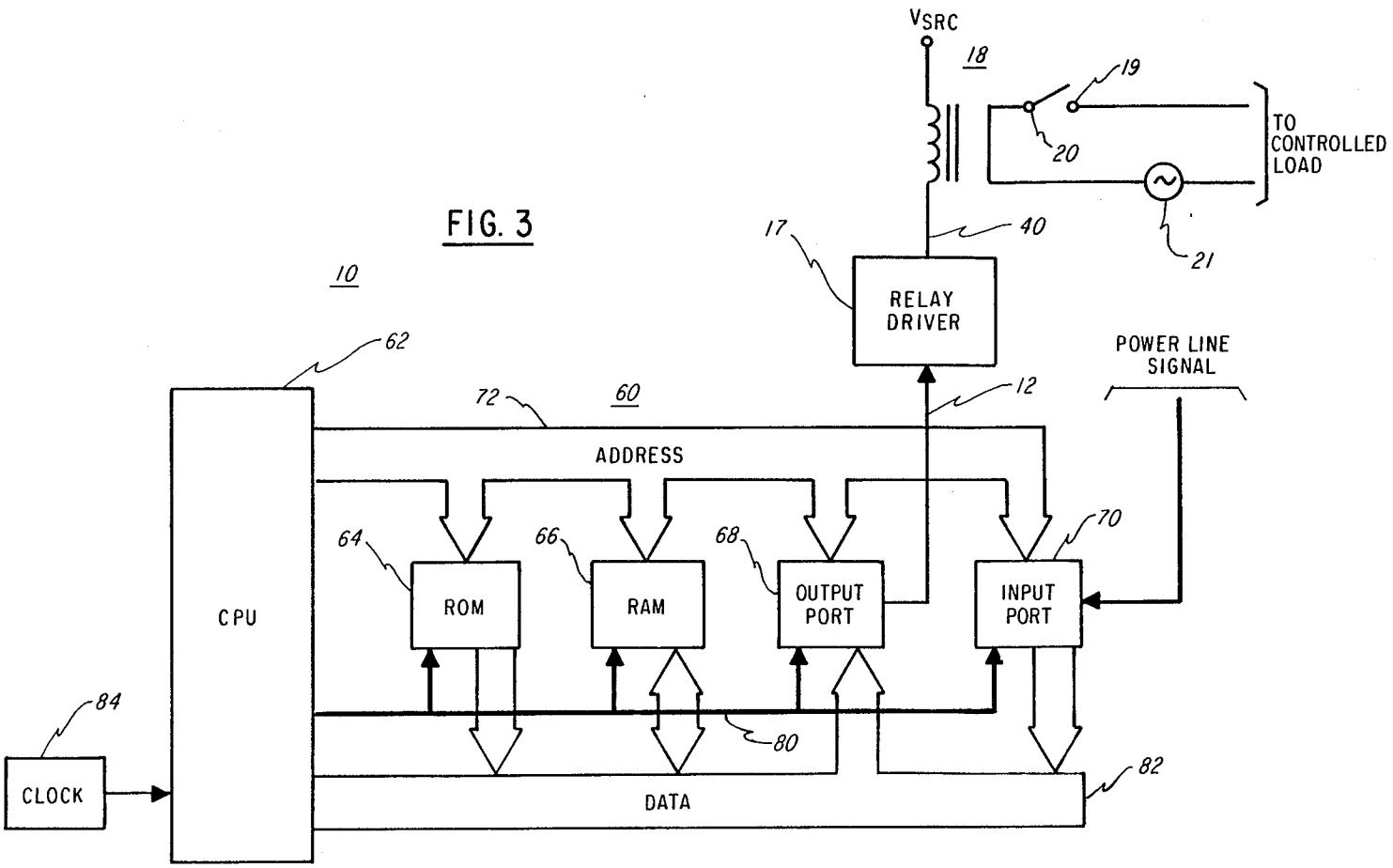
FIG. 3 illustrates a microprocessor-based embodiment of the present invention.

Turning to FIG. 3, there is shown a block diagram of the controlled contact closure system 10. In this embodiment, the controlled contact closure system 10 is implemented with a digital computer, more specifically by a microcomputer. FIG. 3 is a block diagram of a microcomputer 60 that may be used. Specifically, the controlled contact closure system 10 includes a central processing unit (CPU) 62, a read-only memory (ROM) 64, a random-access memory (RAM) 66, an output port 68, and an input port 70. The CPU 62 provides address information via an address bus 72 with the ROM 64, the RAM 66, and the output port 68. Via control lines 80 the CPU 62 controls the ROM 64, the RAM 66, the output port 68, and the input port 70. Data is transferred bidirectionally on the data bus 82, which connects the CPU 62 with the ROM 64, the RAM 66, the output port 68, and the input port 70. The clock 84 provides an appropriate clock signal to the CPU 62.

In this embodiment, the functions of the oscillator 30, the counter 32, the synchronizer 34, the timeslot selector 44, the control source 13, the flip flop 14, and the comparator 22 are performed by the microcomputer 60. The power line signal is input to the microcomputer 60 via the input port 70, and the control information 12 is output to the relay driver 17 via the output port 68.

The control logic of the microcomputer 60 performs the comparator function and passes the control information to the relay driver 17 at the preset timeslots via the output port 62.

Figure 4:
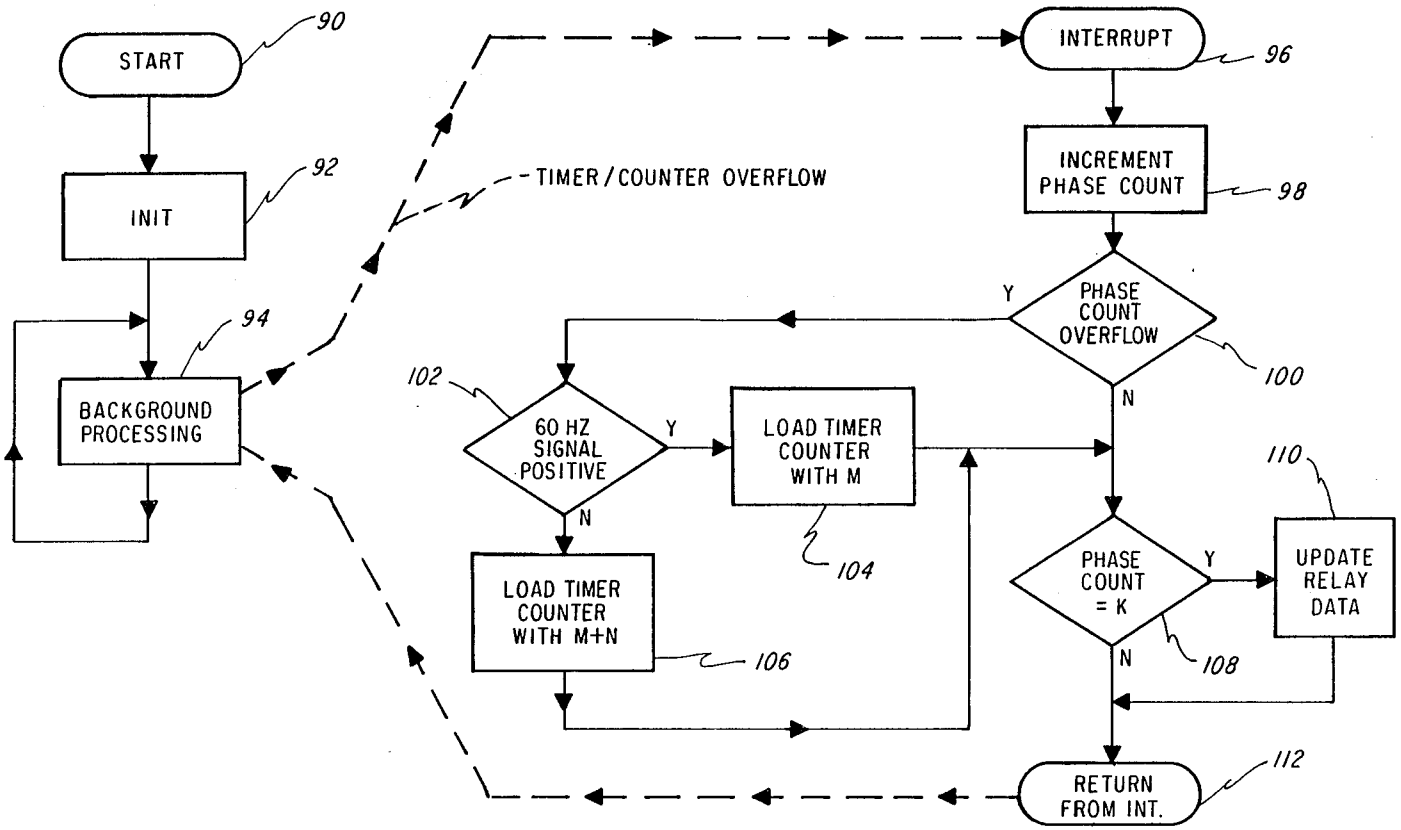
FIG. 4 is a software flow chart for running on the microprocessor-based embodiment of FIG. 3.

FIG. 4 illustrates one implementation for the controlled contact closure system 10 illustrated in FIG. 3. This implementation involves a software flowchart processed by the microcomputer 60 and operates continuously to control the relay 18. The controlled contact closure system flowchart is entered at an entry point 90 and initialized at a step 92.

In one embodiment, relay control operates in an interrupt mode while the microprocessor 60 controls and/or operates a system in which the relay 18 is incorporated. This background processing is represented in FIG. 4 by a step 94.

In one embodiment the ac power line signal is divided down by 12 to generate a 720 Hz signal that is used to produce the count signal, which represents the phase angle of the ac power line signal. That is, in this embodiment there are 12 counts for every cycle of the power line signal, if a higher resolution count signal is desired, a number greater than 12 may be used. Thus, an interrupt signal with a frequency of 720 Hz moves processing to an interrupt entry step 96 of the FIG. 4 flowchart. Next the present value of the count signal is incremented at a step 98. At a decision step 100 the microprocessor 60 determines whether the count has exceeded a predetermined overflow value. In the embodiment under discussion this value would be 12.

If the overflow has not been exceeded, processing moves to a decision step 108 where it is determined whether the phase angle count equals K, where K is the phase angle count where it is desired to energize or deenergize the relay 18. If the response is affirmative, processing moves to a step 110 labelled "Update Relay Data", where the relay is energized or deenergized from the output port 68 as required. If the count is not equal to K or after the step 110, processing moves to a step 112. The step 112 returns processing from the interrupt back to the background processing 94. The next interrupt occurs when it is again time to increment the phase angle count, that is, every 60 cycles of the 720 Hz.

If the result at the decision step 100 is affirmative, i.e., the count has reached its maximum value of 12, processing moves to a decision step 102 where the 60 Hz ac signal is checked to see if it is in the positive portion of the cycle. When the ac signal is positive, processing moves to a step 104 where a value M is loaded into the timer/counter; M represents the value at which the timer/counter resets. In one embodiment, M is selected so that the length of time for the total count sequence is just a little shorter than the time for the power line phase to go through a full 360 degrees. If the ac signal has not yet gone positive processing moves from the decision step 102 to a step 106 where the timer/counter is loaded with a reset value of M+N. This higher reset value stretches the length of the next count cycle slightly. The decision step 102 and the steps 104 and 106 are a self-locking feature to compensate for drifts in the ac signal. If the phase count is ahead of the ac signal a longer count is reset value is loaded into the timer/-counter so that over the next few cycles the count and the ac signal will be resynchronized. Otherwise, M is the reset value that resets the counter at the end of the next ac cycle and is loaded into the timer/counter.

Figure 5:
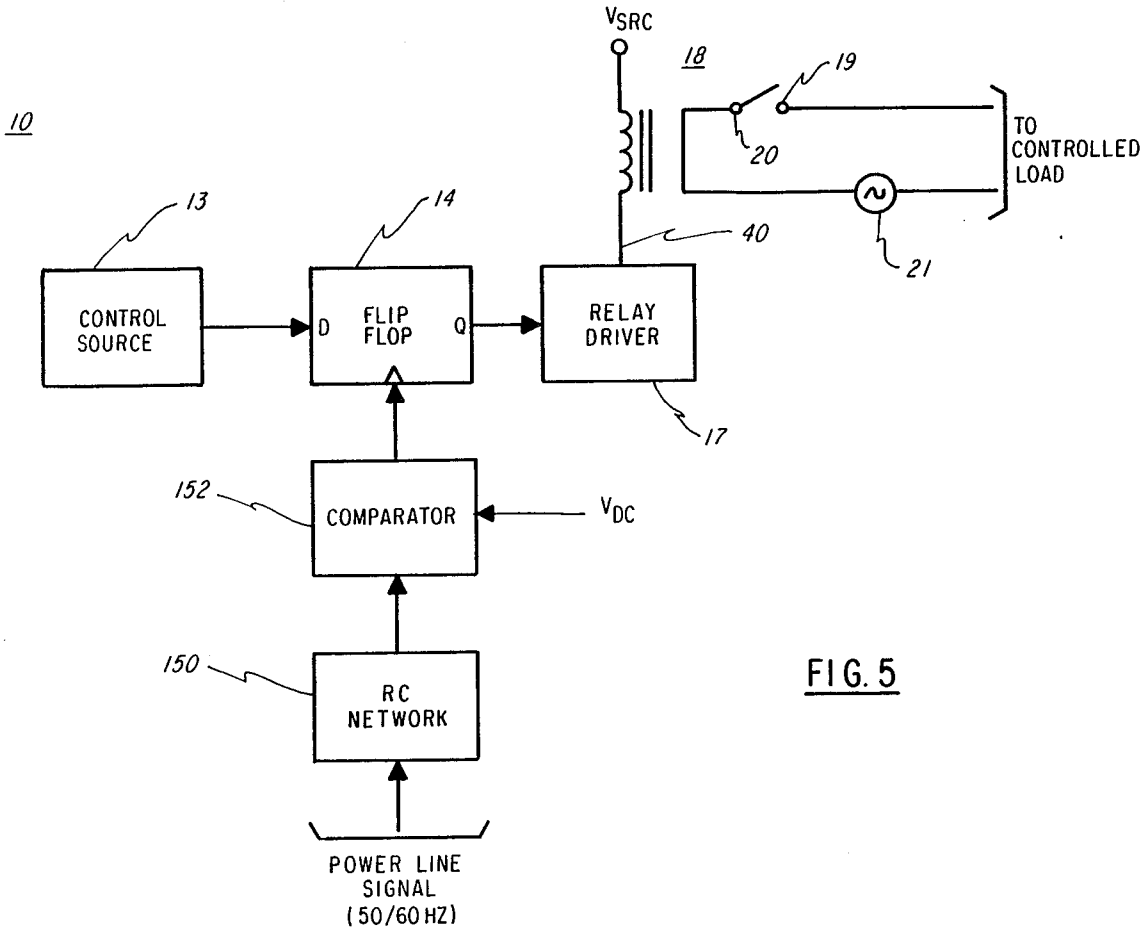
FIG. 5 is a block diagram of another embodiment of the present invention.

In another embodiment of the present invention, the digital implementation of FIG. 1 can be replaced by analog implementation illustrated in FIG. 5. The ac power line signal is input to a resistive-capacitive (RC) network 150 where the product of R and C determines the phase delay between the input ac power line sinusoidal signal and the output sinusoidal signal. The delayed sinusoidal signal is transformed to a square wave in a comparator 152, where the delayed sinusoid is compared to a dc reference voltage V DC. The square wave signal clocks the flip flop 14 so that the control information from the control source 13 passes through the flip flop 14 to the relay driver 17. The RC network is designed to provide the required phase delay between the input ac power line signal and the output sinusoidal signal so that the flip flop 14 is clocked at the time when the ac power line signal is at approximately 0 degrees phase angle.

While I have shown and described several embodiments in accordance with the present invention, it is understood that the same is not limited to these implementations as there are numerous changes and modifications known to a person skilled in the art, and I therefore do not wish to be limited to the details shown and described herein but intend to cover all such changes and modifications as are obvious to one of ordinary skill in the art.

What is claimed is:

1. Where alternating current is applied to a load through electrical contacts, a contact-switching circuit for opening and closing the electrical contacts at a predetermined phase angle of the alternating current signal, comprising:

means for providing the alternating current signal;

first means responsive to said alternating current signal for producing a count signal that represents successive phase angles of said alternating current signal;

means for providing a selectable fixed timeslot count representing the alternating current phase angle at which movement of the electrical contacts must be initiated so that the contacts will reach their desired position at a predetermined phase angle;

comparator means for comparing said count signal and said fixed timeslot count and for producing an enable signal when there is a predetermined relationship therebetween;

means for providing a control signal; and means for controlling the electrical contacts in response to said control signal when enabled by said enable signal.

2. The contact-switching circuit of claim 1 wherein the first means includes:

an oscillator synchronized to the alternating current signal for producing an oscillating signal having a frequency that is approximately a multiple of the alternating current frequency; and a counter responsive to said oscillating signal for producing the count signal in response thereto.

3. The contact-switching circuit of claim 2 wherein the counter increments one count for each cycle of the oscillating signal.

4. The contact-switching circuit of claim 2 including synchronization means disposed so as to be responsive to the alternating current signal for producing a synchronization signal that is input to the oscillator for synchronizing the oscillator to the alternating current signal.

5. The contact-switching circuit of claim 2 including synchronization means disposed so as to be responsive to the alternating current signal for producing a synchronization signal that is input to the counter for synchronizing the counting action of the counter to the alternating current signal.

6. The contact-switching circuit of claim 1 wherein the predetermined timeslot count represents the time for initiating the opening of the electrical contacts such that the electrical contacts will open at a predetermined phase angle of the alternating current signal.

7. The contact-switching circuit of claim 6 wherein the predetermined phase angle is 0 degrees.

8. The contact-switching circuit of claim 1 wherein the predetermined timeslot count represents the time for initiating the closing of the electrical contacts such that the electrical contacts will close at a predetermined phase angle of the alternating current signal.

9. The contact-switching circuit of claim 8 wherein the predetermined phase angle is 0 degrees.

10. The contact-switching circuit of claim 1 wherein the predetermined relationship is that the count signal is within plus or minus one count of the timeslot count.

11. The contact-switching circuit of claim 1 wherein the control signal causes the electrical contacts to open upon occurrence of the enable signal.

12. The contact-switching circuit of claim 1 wherein the control signal causes the electrical contacts to close upon occurrence of the enable signal.

13. The contact-switching circuit of claim 1 wherein the means for controlling the electrical contacts includes:

a D-type flip-flop having a D input terminal responsive to the control signal, a clock terminal responsive to the enable signal and a Q output terminal;

a relay driver having an input terminal connected to the Q output terminal of said D-type flip-flop, and an output terminal; and a coil connected between a voltage source and the output terminal of the relay driver, wherein said coil is proximate said electrical contacts for control thereof.

14. The contact-switching circuit of claim 13 wherein when the coil is energized the electrical contracts are open and when the coil is deenergized the electrical contacts are closed.

15. The contact-switching circuit of claim 13 wherein when the coil is energized the electrical contacts are closed and when the coil is deenergized the electrical contacts are open.

16. Where alternating current is applied to a load through electrical contacts, a contact-switching circuit for opening and closing the electrical contacts at a predetermined phase angle of the alternating current signal, comprising:

means responsive to said alternating current signal for producing a delayed alternating current signal; initiation of relay contact movement and termination of relay contact movement at the desired relay contact position;

means responsive to said delayed alternating current signal for converting said delayed alternating current signal to a square wave signal by limiting the amplitude of said alternating current signal to a predetermined threshold;

means for providing a control signal;

means for controlling the electrical contacts in response to said control signal when enabled by said square wave signal;

wherein said squared delayed signal enables the means for controlling at the time when the electrical contacts should begin movement so that movement is approximately completed and the electrical contacts are in their final position at the zero phase angle of the alternating current signal.

17. The contact-switching circuit of claim 16 including a dc voltage source for producing a dc voltage, wherein the means responsive to the delayed alternating current signal includes a comparator having a first terminal responsive to the delayed alternating current signal and a second terminal responsive to said dc voltage.

18. The contact-switching circuit of claim 16 wherein the means for controlling includes a flip flop and wherein the square wave signal is input to the clock terminal thereof.

19. The contact-switching circuit of claim 16 wherein the means responsive to the alternating current signal is an RC network, wherein the RC time constant determines the phase delay between the alternating current signal and the delayed alternating current signal.

20. Where alternating current is applied to a load through electrical contacts, a contact switching circuit for opening and closing the electrical contacts at a predetermined phase angle of the alternating current signal, comprising:

means responsive to the alternating current signal for producing an enable signal having a predetermined phase relation to the alternating current signal;

means for providing a control signal;

means for controlling the electrical contacts in response to said control signal when enabled by said enable signal; and wherein the predetermined phase relation is such that the enable signal enables the means for opening or closing at the time when the electrical contacts should begin movement so that movement is approximately completed and the contacts have reached their final position at the zero phase angle of the alternating current signal.

21. The contact-switching circuit of claim 1 including means for measuring the phase angle at which the relay contacts open and close and for producing a feedback signal representative thereof, wherein said feedback signal is input to the means for providing the fixed timeslot count for modifying the fixed timeslot count so that the relay contacts will reach their desired position at the predetermined phase angle.

* * * * *